US005997319A

United States Patent [19]

Wu

[11] Patent Number: 5,997,319

[45] Date of Patent: Dec. 7, 1999

[54] PLUG SOCKET

[76] Inventor: Cheng-Lung Wu, No. 43, Sec. 1, Chung-Hua West Road, Tainan, Taiwan

[21] Appl. No.: 09/173,028

[22] Filed: Oct. 15, 1998

[51] Int. Cl.[6] ..... H01R 13/44

[52] U.S. Cl. ..... 439/143; 439/139

[58] Field of Search ..... 439/139, 143

[56] References Cited

U.S. PATENT DOCUMENTS

| | | | |
|---|---|---|---|
| 2,498,642 | 2/1950 | Bellek | 439/139 |
| 4,395,082 | 7/1983 | Rumble | 439/139 |
| 5,066,238 | 11/1991 | Shieh | 439/139 |
| 5,743,753 | 4/1998 | Yen | 439/143 |
| 5,842,878 | 12/1998 | Huag | 439/139 |
| 5,866,846 | 2/1999 | Huag | 439/139 |
| 5,902,140 | 5/1999 | Cheung et al. | 439/139 |

*Primary Examiner*—Neil Abrams

*Attorney, Agent, or Firm*—Rosenberg, Klein & Lee

[57] ABSTRACT

A plug socket is composed by a lower housing, an upper housing, a coiled spring strip and a turning tray. In the lower housing are provided with conductive clips. A circular trough is provided in the top portion of the upper housing. A plurality of plug slots and a hollow with a central hole are provided in the circular trough. The hollow is provided for the coiled spring strip to be placed in, and the inner wall of the hollow is provided with an inserting groove for the outer end of the coiled spring strip to be inserted into. The turning tray is provided to be inlaid in the circular trough. On the bottom of the turning tray is protrudently provided with an axle, which has an inserting groove for the inner end of the coiled spring strip to be inserted into. The axle is provided to penetrate through the passing hole and then to be pivoted in a retaining ring. The turning tray is provided with a plurality of plug slots. In normal times, the turning tray can cover the plug slots of the upper housing to prevent from dust and water and to prevent children from playing with the plug slots and from getting an electric shock.

3 Claims, 4 Drawing Sheets

PLUG SOCKET

BACKGROUND OF THE INVENTION

Field of the Invention

This invention relates to a plug socket whose plug slots are covered in normal times in order to prevent from dust and water and to prevent children from playing with the plug slots and from getting an electric shock.

Generally speaking, children are very curious about everything so as to do many surprising things. For example, they would play with plugs and plug sockets and easily get an electric shock.

SUMMARY OF THE INVENTION

Therefore, an objective of the present invention is to provide a plug socket whose turning tray covers the plug slots of the upper housing so as to prevent from dust and water in normal times and to prevent children from playing with the plug slots and from getting an electric shock.

Another objective of the present invention is to provide a plug socket which is easily operated because it can get electric power only to plug the pins of a plug in the plug slots of the turning tray and then to turn a certain angle so as to penetrate through the plug slots of the upper housing and into the conductive clips of the lower housing.

A further objective of the present invention is to provide a plug socket which has simple structure.

Accordingly, a plug socket is composed by a lower housing, an upper housing, a coiled spring strip and a turning tray. In the lower housing are provided with conductive clips. A circular trough is provided in the top portion of the upper housing. A plurality of plug slots and a hollow with a central hole are provided in the circular trough. The hollow is provided for the coiled spring strip to be placed in, and the inner wall of the hollow is provided with an inserting groove for the outer end of the coiled spring strip to be inserted into. The turning tray is provided to be inlaid in the circular trough. On the bottom of the turning tray is protrudently provided with an axle, which has an inserting groove for the inner end of the coiled spring strip to be inserted into. The axle is provided to penetrate through the passing hole and then to be pivoted in a retaining ring. The turning tray is provided with a plurality of plug slots. In normal times, the turning tray can cover the plug slots of the upper housing to prevent from dust and water and to prevent children from playing with the plug slots and from getting an electric shock.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
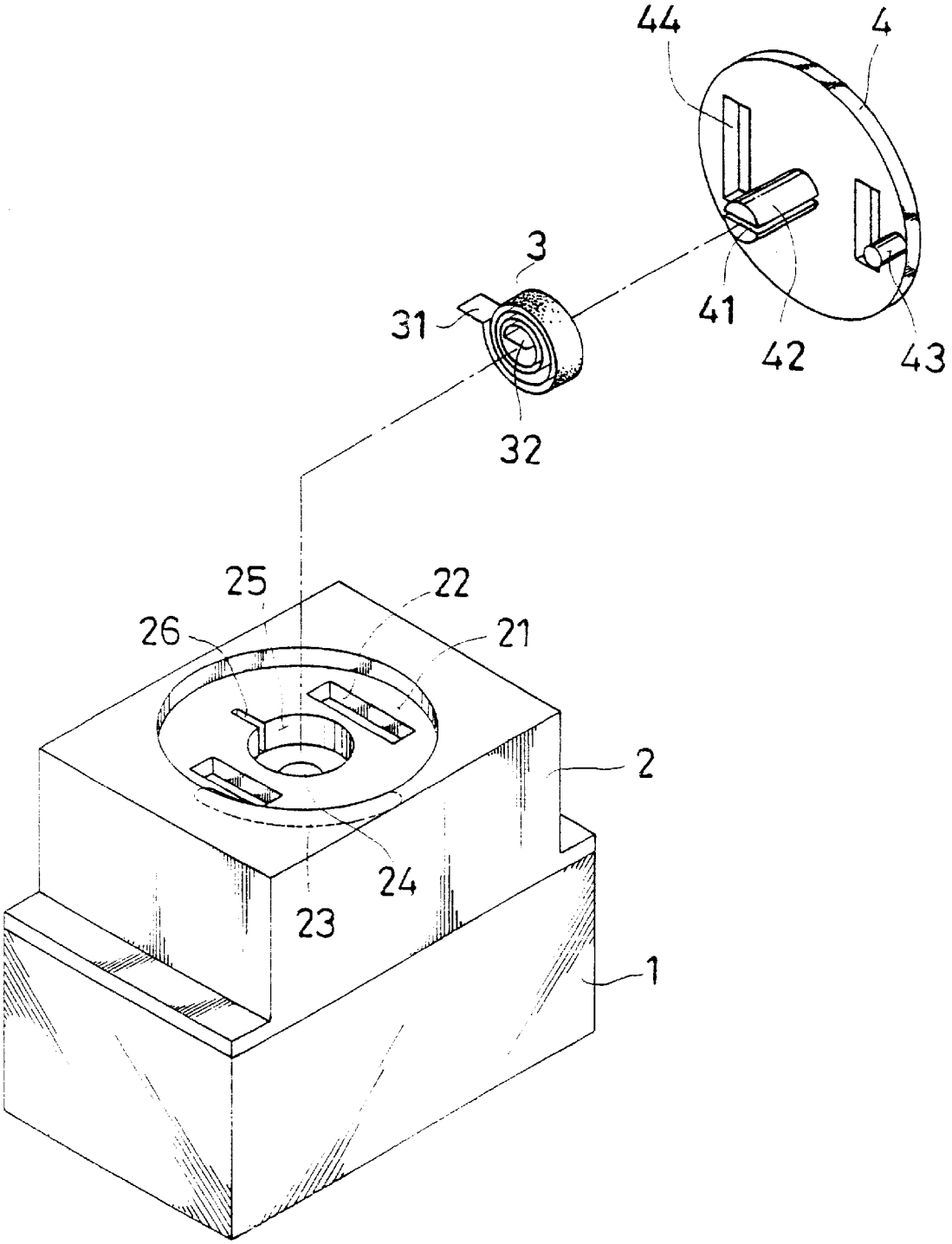
FIG. 1 is a decomposed perspective view of a plug socket in the present invention.

First, referring to FIG. 1, a plug socket is composed by a lower housing 1, an upper housing 2, a coiled spring strip 3 and a turning tray 4.

In the lower housing 1 are provided with conductive clips 11. A circular trough 21 is provided in the top portion of the upper housing 2; a plurality of plug slots 22, a long guidance groove 23 and a hollow 25 with a central passing hole 24 are provided in the circular trough 21. The hollow 25 is provided for the coiled spring strip 3 to be placed in, and the inner wall of the hollow 25 is provided with an inserting groove 26 for the outer end 31 of the coiled spring strip 3 to be inserted into.

The turning tray 4 is provided to be inlaid in the circular trough 21; on the bottom of the turning tray 4 is protrudently provided with an axle 42 which has an inserting groove 41 for the inner end 32 of the coiled spring strip 3 to be inserted into. The axle 42 is provided to penetrate through the passing hole 24 and then to be pivoted in a retaining ring 27. On the bottom of the turning tray 4 is protrudently provided with a guidance rod 43 to be inserted into the guidance groove 23. A plurality of plug slots 44 are provided in the turning tray 4.

Figure 3:
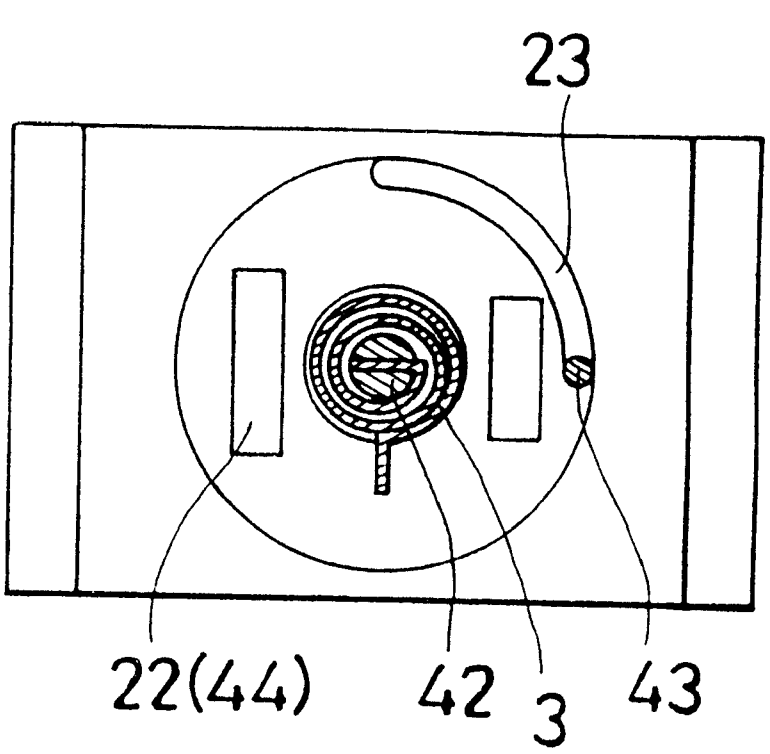
FIG. 3 is top plan of the plug socket after being used in the present invention.
Figure 2:
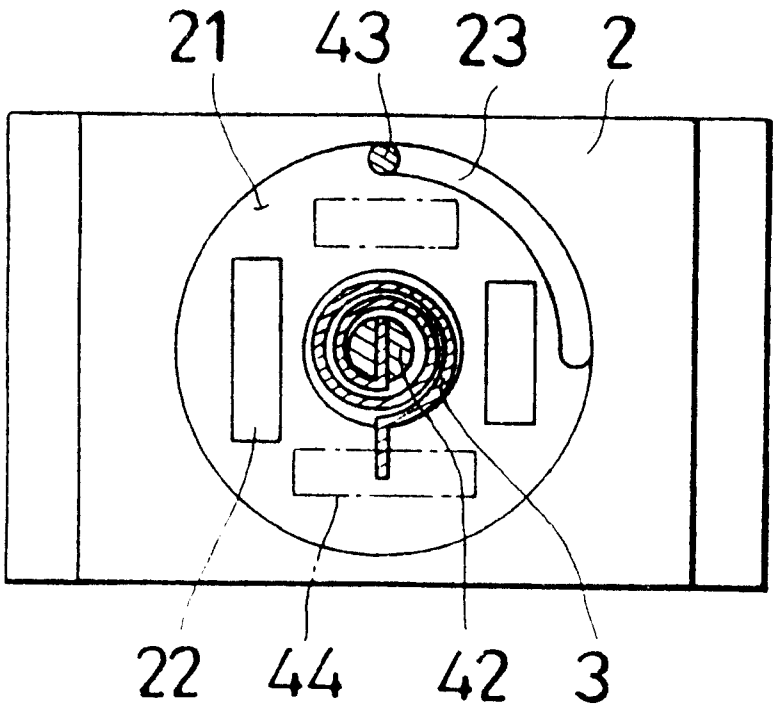
FIG. 2 is a composed top plan of the plug socket before being used in the present invention.

Referring to FIGS. 2 and 3, after the turning tray 4 being turned to a certain angle, the plug slots 44 of the turning tray 4 will lap over the plug slots 22 of the upper housing 2. In normal times, the turning tray 4 is inlaid in the top portion of the upper housing 2 and covers the plug slots 22 of the upper housing 2; that is, the plug slots 44 of the turning tray 4 will not lap over the plug slots 22 of the upper housing 2 so as to prevent from dust and water and to prevent children from playing with the plug slots 22 and from getting an electric shock.

Figure 4:
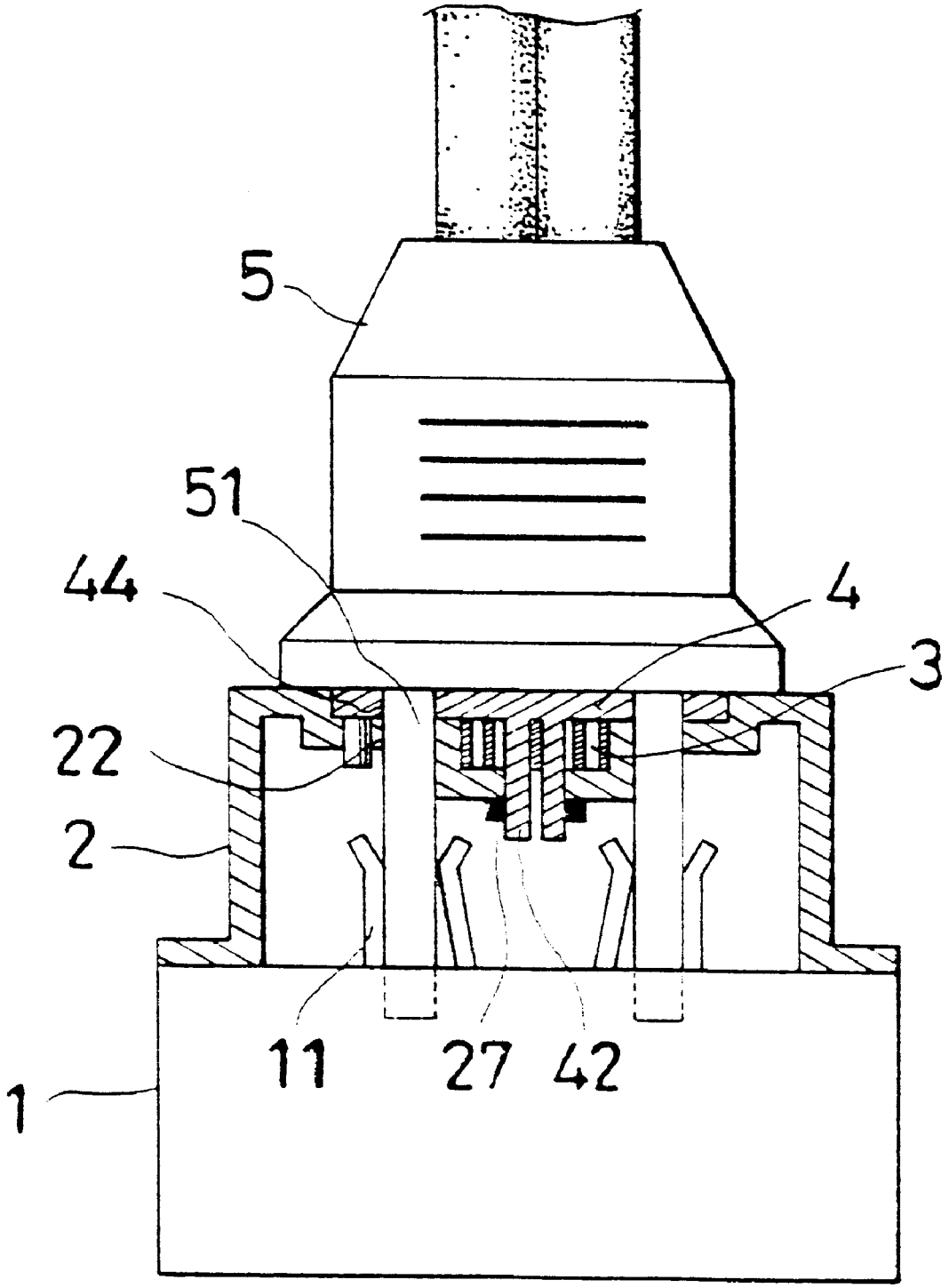
FIG. 4 is a side-sectional view of the plug socket while being used in the present invention.

Referring to FIG. 4, when using, plug the pins 51 of a plug 5 in the plug slots 44 of the turning tray 4, and then turn the plug 5 as well as the turning tray 4. The turning tray 4 can be turned smoothly by the guidance rod 43 moving in the guidance groove 23; at the same time, the axle 42 of the turning tray 4 will elastically roll and compress the coiled spring strip 3. After the turning tray 4 being turned to a certain angle, the plug slots 44 of the turning tray 4 will lap over the plug slots 22 of the upper housing 2 so as to let the plug pins 51 penetrate through the plug slots 22 of the upper housing 2 and the conductive clips 11 of the lower housing 1 accordingly to get electricity. On the contrary, after the plug pins 51 of the plug 5 being pulled out, the turning tray 4 will elastically restore to its normal position by the elasticity of the coiled spring strip 3.

The plug socket in the present invention can be plugged in by a two-pin plug, a three-pin plug or a multi-pin plug only to change the numbers of the plug slots 22 of the upper housing 2 and the plug slots 44 of the turning tray 4 according to the numbers of the plug pins.

Figure 6:
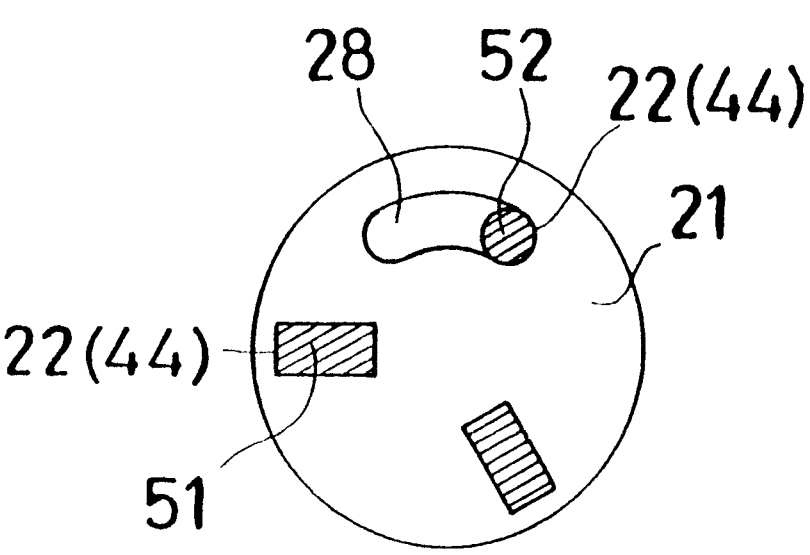
Figure 5:
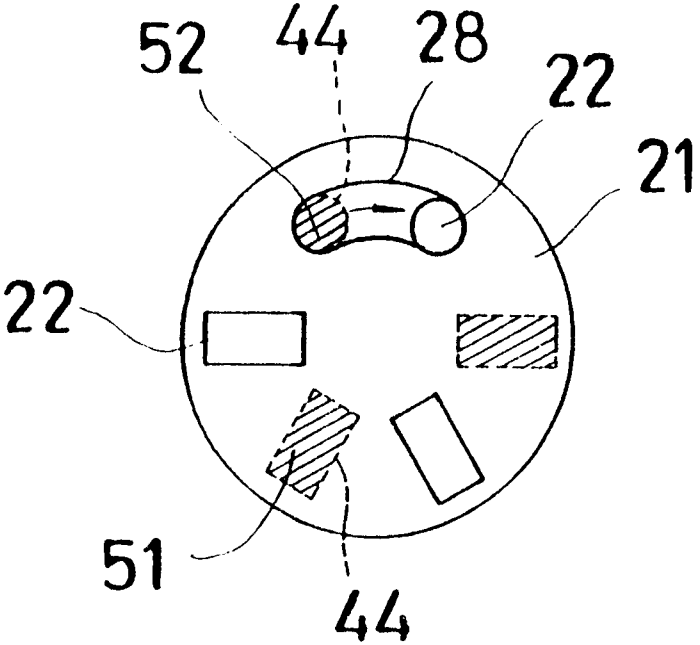
FIG. 5 is a schematic view of another preferred embodiment of a plug socket before being used in the present invention; and, FIG. 6 is a schematic view of another preferred embodiment of a plug socket after being used in the present invention.

Furthermore, referring to FIGS. 5 and 6, to take a three-pin plug for example, because the earthing plug pin 52 is slightly longer than the other two plug pins 51, in the upper housing 2 may be provided with a sleeve groove 28 close to the plug slot 22 which is for the earthing plug pin 52 to be plugged in. The sleeve groove 28 is provided to receive the end of the earthing plug pin 52, and the depth of the sleeve groove 28 is at least equal to the balance that the length of the earthing plug pin 52 subtracts the length of one of the plug pins 51. Therefore, after two plug pins 51 and the earthing plug pin 52 being plugged in the plug slots 44 of the turning tray 4, two plug pins 51 will be against by the bottom surface of the circular trough 21, and the end of the earthing plug pin 52 will insert in the sleeve groove 28 so as to let the three-pin plug 5 be smoothly plugged in the turning tray 4 and not to be slant; accordingly, the three-pin plug 5 as well as the turning tray 4 can be turned successfully.

While the preferred embodiments of the invention have been described above, it will be recognized and understood that various modifications may be made therein and the appended claims are intended to cover all such modifications which may fall within the spirit and scope of the invention.

What is claimed is:

1. A plug socket comprising:

a lower housing being provided with conductive clips;

an upper housing being provided with a circular trough in the top portion, in said circular trough being provided with a plurality of plug slots and a hollow, said hollow being provided with a passing hole in the center and an inserting groove in the inner wall;

a coiled spring strip being provided to be inserted in said hollow, said coiled spring strip having an inner end and an outer end, said outer end being provided to be inserted in said inserting groove of said hollow; and, a turning tray being provided to be inlaid in said circular trough, on the bottom of said turning tray being protrudently provided with an axle, said axle having an inserting groove for said inner end of said coiled spring strip to be inserted into and then penetrating through said passing hole to be pivoted in a retaining ring, said turning tray being provided with a plurality of plug slots, while being used, plug pins of a plug being plugged in said plug slots of said turning tray, and then said plug as well as said turning tray being turned to a certain angle to let said plug slots of said turning tray lap over said plug slots of said upper housing so as to let said plug pins penetrate through said plug slots of said upper housing and insert in said conductive clips of said lower housing.

2. The plug socket as claimed in claim 1, wherein in proper position of said circular trough of said upper housing is provided with a long guidance groove, and on the bottom of said turning tray is protrudently provided with a guidance rod to insert in said guidance groove for said turning tray to turn smoothly.

3. The plug socket as claimed in claim 1, wherein when said plug socket is provided for a three-pin plug and an earthing plug pin of said three-pin plug is longer than other two plug pins, in said upper housing is provided with a sleeve groove close to said plug slot for said earthing plug pin, said sleeve groove is provided to receive the end of said earthing plug pin, and the depth of said sleeve groove is at least equal to the balance that the length of said earthing plug pin subtracts the length of one of said two plug pins.

* * * * *